US006638369B1

(12) United States Patent
Tucker et al.

(10) Patent No.: US 6,638,369 B1
(45) Date of Patent: Oct. 28, 2003

(54) NON-CHROMATE CONVERSION COATINGS

(75) Inventors: Wayne C. Tucker, Exeter, RI (US); Maria G. Medeiros, Bristol, RI (US); Richard Brown, Wakefield, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/143,176

(22) Filed: May 7, 2002

(51) Int. Cl.[7] ..... C23C 22/48

(52) U.S. Cl. ..... 148/247; 148/243; 148/273; 106/14.11

(58) Field of Search ..... 148/243, 247, 148/273; 106/14.11; 428/472, 472.1

(56) References Cited

U.S. PATENT DOCUMENTS 2,796,371 A * 6/1957 Ostrander et al. ..... 148/268
4,987,164 A * 1/1991 Kauffman et al. ..... 524/413
5,451,271 A * 9/1995 Yoshida et al. ..... 148/247
6,524,403 B1 * 2/2003 Bartlett et al. ..... 148/247
6,560,845 B2 * 5/2003 Serafin et al. ..... 29/469.5

FOREIGN PATENT DOCUMENTS

KR 2001084027 A * 9/2001
SU 503897 A * 3/1976

* cited by examiner

*Primary Examiner*—John Sheehan
*Assistant Examiner*—Andrew L. Oltmans
(74) *Attorney, Agent, or Firm*—James M. Kasischke; Michael F. Oglo; Jean-Paul A. Nasser

(57) ABSTRACT

A non-chromate conversion coating and method of applying same wherein the coating comprises a titanate, such as potassium titanate or sodium metatitanate, as a "drop-in replacement" for a chromate in an otherwise chromate-containing conversion coating.

13 Claims, No Drawings

NON-CHROMATE CONVERSION COATINGS

CROSS REFERENCE TO OTHER PATENT APPLICATIONS

This patent application is co-pending with one related patent application Ser. No. 10/143,173 entitled NON-CHROMATE METAL SURFACE ETCHING SOLUTIONS,by the same inventors as this application.

STATEMENT OF GOVERNMENT INTEREST

The invention described herein may be manufactured and used by or for the Government of the United States of America for Governmental purposes without the payment of any royalty thereon or therefor.

BACKGROUND OF THE INVENTION (1) Field of the Invention

The present invention relates to a non-chromate conversion coating and method of treating a metal surface with same, and more particularly, to a "drop-in replacement", such as a titanate, for a chromate in a conventional conversion coating solution that otherwise would contain the chromate.

(2) Description of the Prior Art

It is known that solutions containing hexavalent chromium can be used to treat the surface of a metal, such as aluminum, to effectively keep the metal surface from rusting. However, although hexavalent chromium is an efficient rust-proofing agent, it is highly toxic and adversely affects the environment and human health. For this reason, many chromate-free chemical conversion coatings for metal surfaces have been proposed.

Thus, various non-chromate conversion coatings, such as the conversion coatings described in Tomlinson U.S. Pat. No. 5,759,244, the disclosure of which is incorporated by reference herein, have been disclosed which are designed to render a metal less reactive in a corrosive environment. Such non-reactive or less reactive metal surfaces produce a corrosion resistant outer layer on the base metal or its oxide thereby leaving the underlying metal protected from the environment. These coatings are applied in one or more stages and are subsequently rinsed with water to remove undesirable contaminants.

Chromate-free conversion coatings are therefore generally based on chemical mixtures that react with a metal substrate surface to form a protective layer. Many of these conversion coatings are based on Group IV–B metals such as titanium, zirconium and hafnium. For example, U.S. Pat. No. 5,743,971 to Inoue et al discloses a rust proof film-forming composition for treating a metal surface comprising an oxidated substance, a silicate and/or silicone dioxide and at least one member selected from the group consisting of metal cations of titanium, zirconium, cerium, strontium, vanadium, tungsten, and molybdenum. A metal substrate is provided a rust proof film by immersing it in the foregoing liquid rust proof film-forming composition. Similarly, U.S. Pat. No. 5,855,695 to McMillen et al discloses a non-chrome passivating composition employed as a post-rinse for enhancing the corrosion resistance of phosphated metal substrates. The composition comprises the reaction product of an epoxy-functional material containing at least two epoxy groups and an alkanolamine, or a mixture of alkanolamines. The non-chrome passivating composition further comprises a Group IV–B metal ion, or a mixture of Group IV–B metal ions. Moreover, U.S. Pat. No. 5,897,716 to Reghi et al discloses a chemically and thermally stable chromate-free aqueous liquid treatment for metals for imparting corrosion resistance thereto. The chromate-free aqueous liquid comprises components selected from the group consisting of $H_2TiF_6$, $H_2ZrF_6$, $H_2HfF_6$, $H_2SiF_6$, $H_2GeF_6$, $H_2SnF_6$, $HBF_4$ and mixtures thereof.

The shortcoming of conventional non-chromate conversion coatings, such as those described above, is that they cannot be integrated into and employed in place of chromates in current metal treatment coatings which employ chromates. As such, conventional non-chromate conversion coatings are usually sufficiently different from previously employed chromate-containing conversion coatings that significant changes are required to be made in the metal treating process and in the production of the conversion coating itself. These changes can amount to substantial expenditures and usually require additional approvals from the Department of the Navy or a regulatory agency of the United States Government. Thus, there is a need for a "drop-in replacement" that can be employed in place of chromate compounds, such as sodium dichromate, now used in conventional chromate conversion coatings. "Drop-in replacement" refers to a compound that can be employed in a conventional conversion coating in lieu or in place of a chromate without requiring any or substantial changes in the make-up of the conversion coating or its substituents.

SUMMARY OF THE INVENTION

It is a primary object of the present invention to provide a non-chromate conversion coating for treating metals which contains a titanate in place of a chromate.

It is a further primary object of the invention to provide a "drop-in replacement" for a chromate that can be employed in a conversion coating which otherwise would employ a chromate.

It is a further primary object of the invention to provide a method of rust-proofing a metal substrate by applying a non-chromate titanate conversion coating thereto.

Another object of the invention is to provide a one-stage method of rust proofing a metal substrate by applying a non-chromate titanate conversion coating thereto including sodium metatinate and/or potassium titanate.

Another object of the invention is to provide a non-chromate conversion coating that excludes therein organic additives, structural component additives or chelating agents.

The objects of the invention are accomplished by providing a highly effective, non-chromate conversion coating which includes a titanate, such as sodium metatitanate or potassium titanate, in lieu of a chromate in a typical conversion coating that otherwise would contain a chromate.

The present invention is developed on the basis of findings that an excellent rust proof film can be obtained by immersing a metal substrate in an aqueous solution which includes sodium dichromate, sodium fluoride, potassium ferricyanide and nitric acid in an amount to provide a pH of 1.2 to 2.2. It is believed that the chromate provides corrosion protection by way of a cathodic reaction, specifically, the reduction of oxygen in the presence of water:

$$O_2+2H_2O+4e^-4OH^- \quad (1)$$

This cathodic reaction is similar for many systems, and by changing the oxygen concentration in the solution, reveals the cathodic behavior of the chromate. Moreover, when the reduction of oxygen is the rate controlling reaction and chromates are present, other metals and lower oxygen levels show similar behavior, that is a lower or decreased limiting current density.

Test results show that a metal tested without a conversion coating has a high limiting cathodic density. For example, untreated Al2024T3 has a limiting cathodic current density of 10–20 A/cm$^2$, however, when a chromate conversion coating is applied, the cathodic limiting current density is lowered to 3–7 A/cm$^2$. However, since personal exposure limits (PEL) for chromates is 0.1 mg/m$^3$ (milligram per cubic meter), chromate containing conversion coatings are not practical for use. Thus, a "drop-in replacement" for the chromate in the chromate-containing conversion coating is highly desired.

Sodium metatitanate and potassium titanate have been found to be well suited as "drop-in replacements" for chromates in conversion coatings which, in addition to sodium dichromate, contain sodium fluoride, potassium ferricyanide and nitric acid. For example, test results show that a conversion coating which includes a "drop-in replacement" according to this invention in place of a chromate produces a metal surface having a cathodic limiting current density of 0.5 to 1 A/cm$^3$. Furthermore, the PEL for such a conversion coating is 15 mg/m$^3$. Thus, the present invention provides a highly effective, non-toxic conversion coating which otherwise would include toxic chromate compounds, such as sodium dichromate.

DESCRIPTION OF THE PREFERRED EMBODIMENT

The present invention will hereafter be described in detail with reference to the following embodiments.

The preferred embodiment of the present invention comprises a non-chromate conversion coating for providing corrosion resistance to metals which includes sodium metatitanate and/or potassium titanate in a conversion coating that otherwise would contain a chromate. The preferred embodiment further includes a method of rust proofing a metal which employs the non-chromate conversion coating of the present invention.

A typical chromate-containing conversion coating employed in a metal treatment process includes sodium dichromate, sodium fluoride, potassium ferricyanide and nitric acid, and more particularly, about 0.025 M (molecular weight in grams per one liter of solvent) sodium dichromate, about 0.024 M sodium fluoride, about 0.015 M potassium ferricyanide and an amount of nitric acid to provide a pH of 1.2 to 2.2. The present invention provides a means of replacing this toxic metal treating solution with a similar, non-toxic variant that includes the original non-chromate constituents and thus, can be easily substituted for the chromate-containing solution and employed in the same metal treating process. Therefore, the preferred embodiment of the present invention provides a conversion coating comprising sodium metatitanate, sodium fluoride, potassium ferricyanide and an amount of nitric acid to provide a pH of about 1.0 to about 6.0. More particularly, the conversion coating of the present invention comprises a solution of about 0–1 M sodium metatitanate, about 0–1 M sodium fluoride, about 0–1 M potassium ferricyanide and a balance of nitric acid to adjust the pH to about 1.0 to about 6.0. Alternatively, potassium titanate can be employed in place of sodium metatitanate. In that case, the conversion coating comprises potassium titanate in an amount ranging from about 4 g/l (grams per liter) to about 8 g/l, sodium fluoride in an amount ranging from about 2 g/l to about 6 g/l and nitric acid to adjust the pH to a range of about 1.0 to about 6.0.

Since the conversion coatings of the present invention are drop-in-replacement compositions, additional additives, including organic additives, structural component additives or chelating agents for keeping the metals therein in solution are not needed. Preferably, therefore, no such additives are included in the compositions.

To provide corrosive resistance to a metal surface by way of the foregoing conversion coatings, the metal surface must first be washed with a solvent, such as methanol or TCE (trichloroethylene) in order to solvent wipe. Thereafter, the surface is degreased with a 2% sodium hydroxide solution or any other suitable degreaser such as a caustic solution for about one minute, at about 50–60° C. Next, the metal surface is rinsed with deionized water to remove any degreaser or solvent on the metal's surface before being immersed in a deoxidizing solution such as SMUTGO®. The metal surface is immersed therein for ten minutes at about room temperature thereby deoxidizing the metal's surface. Thereafter, the metal surface is again rinsed with deionized water to remove any deoxidizing solution on its surface before the non-chromate conversion coating of the present invention is applied. It is preferred that the conversion coating be around about 60–80° C. during application. Lastly, the metal is rinsed in a deionized water and allowed to air dry. An advantage of the present method is that the non-chromate conversion coating herein has only to be applied once to the metal substrate, thus, the present method is a one-stage process. Prior art non-chromate coatings and methods of applying same can require multiple applications. Further, by rinsing the metal surface following applying the present conversion coating, a dry-on polymer surface coating is not disposed on the metal surface as is the case with prior art coatings.

A metal substrate, such as aluminum, that undergoes the foregoing treatment is provided a lower cathodic limiting current density than if allowed to go untreated. Specifically, test results show that application of the non-chromate conversion coating of the present invention to Al2024T3 results in a cathodic limiting current density of 0.5 to 1 A/cm$^2$. Test results were attained using a salt spray test over ten days.

While the preferred embodiment of the non-chromate conversion coating and method of applying same has been described in detail above, various modifications and variations of the invention are possible in light of the above teachings. For example, boric acid can be employed in place of nitric acid to adjust the pH of the conversion coating. It is therefore understood that within the scope of the appended claims the invention may be practiced otherwise than above-described.

What is claimed is:

1. A non-chromate conversion coating comprising:

sodium metatitanate, sodium fluoride, potassium ferricyanide and nitric acid.

2. A non-chromate conversion coating in accordance with claim 1 having a pH ranging from about 1.0 to about 6.0.

3. A non-chromate conversion coating in accordance with claim 1 wherein the sodium metatitanate is present in a concentration ranging from greater than 0 to about 1 M, the sodium fluoride is present in a concentration ranging from greater than 0 to about 1 M and potassium ferricyanide is present in a concentration ranging from greater than 0 to about 1 M.

4. A non-chromate conversion coating comprising:

sodium metatitanate in a concentration ranging from greater than 0 to about 1 M;

sodium fluoride in a concentration ranging from greater than 0 to about 1 M;

potassium ferricyanide in a concentration ranging from greater than 0 to about 1 M; and nitric acid;

wherein the coating has a pH ranging from about 1.0 to about 6.0.

5. A non-chromate conversion coating according to claim 4 excluding organic additives, structural component additives and/or chelating agents.

6. A non-chromate conversion coating comprising:

potassium titanate, sodium fluoride and nitric acid.

7. A non-chromate conversion coating in accordance with claim 6 having a pH ranging from about 1.0 to about 6.0.

8. A non-chromate conversion coating in accordance with claim 6 potassium titanate is present in an amount ranging from about 4 g/l to about 8 g/l and sodium fluoride is present in an amount ranging from about 2 g/l to about 6 g/l.

9. A non-chromate conversion coating comprising:

potassium titanate in an amount ranging from about 4 g/l to about 8 g/l;

sodium fluoride in an amount ranging from about 2 g/l to about 6 g/l; and nitric acid;

wherein the coating has a pH ranging from about 1.0 to about 6.0.

10. A non-chromate conversion coating in accordance with claim 9 excluding organic additives, structural component additives and/or chelating agents.

11. A method of providing corrosion protection to a metal surface comprising:

applying the non-chromate conversion coating of claim 1, 4, 5, 6, 8, 9 or 10 to the metal surface.

12. A method in accordance with claim 11 further comprising washing the metal surface with a first solvent; degreasing the metal surface; rinsing the metal surface in deionized water or a second solvent a first time; applying a deoxidizing solution to the metal surface; rinsing the metal surface in deionized water a second time after applying the non-chromate conversion coating; and air drying the metal surface.

13. A method in accordance with claim 12 wherein the first solvent is methanol or TCE; the degreaser is a sodium hydroxide solution applied to the metal surface for about 1 minute at a temperature ranging from about 50° C. to about 60° C.; the metal surface is immersed in the deionized water or the second solvent for about ten minutes at about room temperature; and the non-chromate conversion coating has a temperature ranging from about 60° C. to about 80° C.

* * * * *